US009675169B1

(12) United States Patent
Lai et al.

(10) Patent No.: US 9,675,169 B1
(45) Date of Patent: Jun. 13, 2017

(54) EXTENDABLE TABLE

(71) Applicants: Fang-Hoang Lai, Taichung (TW); Cheng-Yuan Hung, Taipei (TW)

(72) Inventors: Fang-Hoang Lai, Taichung (TW); Cheng-Yuan Hung, Taipei (TW)

( * ) Notice: Subject to any disclaimer, the term of this patent is extended or adjusted under 35 U.S.C. 154(b) by 0 days.

(21) Appl. No.: 15/149,901

(22) Filed: May 9, 2016

(51) Int. Cl.

| | |
|---|---|
| ***A47B 85/00*** | (2006.01) |
| ***A47B 1/10*** | (2006.01) |
| ***A47B 13/08*** | (2006.01) |
| ***A47B 1/04*** | (2006.01) |

(52) U.S. Cl.
CPC ..... *A47B 1/10* (2013.01); *A47B 1/04* (2013.01); *A47B 13/081* (2013.01); *A47B 13/088* (2013.01); *A47B 2001/105* (2013.01)

(58) Field of Classification Search
CPC .... A47B 1/08; A47B 1/05; A47B 1/02; A47B 1/04; A47B 1/10; A47B 2001/025; A47B 2001/105; A47B 2001/035; A47B 2001/053
USPC ..... 108/73, 70, 71, 72, 78, 89, 84, 85, 69
See application file for complete search history.

(56) References Cited

U.S. PATENT DOCUMENTS 451,597 A * 5/1891 Magnussan ..... A47B 1/02 108/84
556,387 A * 3/1896 Unger ..... A47B 35/00 108/63
726,853 A * 5/1903 Borgmann ..... A47B 1/05 108/72
1,096,906 A * 5/1914 Grumstrup ..... A47B 1/02 108/115
1,385,445 A * 7/1921 Gunn ..... A47B 1/05 108/63
1,388,708 A * 8/1921 Hermans ..... A47B 1/05 108/73
1,647,224 A * 11/1927 Henricson ..... A47B 1/10 108/87
1,853,009 A * 4/1932 Walter ..... A47B 1/05 108/70
1,861,565 A * 6/1932 Hall ..... A47B 1/02 108/84
1,887,266 A * 11/1932 Karlson ..... A47B 1/02 108/85
2,240,551 A * 5/1941 Cooper ..... A47B 1/02 108/75
3,033,629 A * 5/1962 Riendeau ..... A47B 1/08 108/85

(Continued)

*Primary Examiner* — Jose V Chen
(74) *Attorney, Agent, or Firm* — Muncy, Geissler, Olds & Lowe, P.C.

(57) ABSTRACT

An extendable table includes a frame and a fixed board mounted on frame. The frame has two extension tubes arranged in parallel. The extension tube has an outer tube receiving two inner tubes therein. A gear wheel is provided on the outer tube and a gear rack is provided on each of the two inner tubes for engaging with the gear wheel, so that the two inner tubes move synchronously. The inner tube has an outer end thereof provided with a moving component. Two movable boards each have one side connected to the moving component and an opposite end laid on the fixed board. The movable boards may be drawn together to form a small tabletop or pulled apart to form, together with the fixed board, an extended tabletop. The inner tubes each have a lifting member that lifts the movable board for easy expanding/retracting operation.

8 Claims, 24 Drawing Sheets

(56) References Cited

U.S. PATENT DOCUMENTS

| | | | | |
|---|---|---|---|---|
| 6,038,985 | A * | 3/2000 | Chang | A47B 1/02 108/84 |
| 8,100,063 | B2 * | 1/2012 | Meyers | A47B 1/05 108/73 |
| 8,365,678 | B2 * | 2/2013 | Morbidelli | A47B 1/05 108/73 |
| 2006/0032415 | A1 * | 2/2006 | Wang | A47B 1/08 108/83 |
| 2012/0079967 | A1 * | 4/2012 | Palese | A47B 37/04 108/71 |

* cited by examiner

EXTENDABLE TABLE

BACKGROUND OF THE INVENTION

1. Technical Field

The present invention relates to furniture, and more particularly to a table with an extendable tabletop.

2. Description of Related Art

A conventional extendable table typically has its tabletop formed by two movable halves. When the two halves are pulled apart, one or two additional boards may be placed therebetween manually, so as to provide an extended tabletop. Alternatively, additional boards may be unfolded to extend the table and folded down to be stored below the tabletop. Such known arrangements require multi-stage operation, and thus are less convenient in use.

SUMMARY OF THE INVENTION

For overcoming the shortcomings of the prior art, the primary objective of the present invention is to provide an extendable table that is easy to operate.

For achieving the foregoing objective, an extendable table of the present invention comprises a frame that is composed of two extension tubes and two connection tubes, four legs fixed to the frame from below, and a fixed board fixed on the frame. The two extension tubes are arranged in parallel and each have an outer tube in which two inner tubes are received. A gear wheel is provided in the middle part of the outer tube, and a gear rack is provided on each of the two inner tubes for engaging with the gear wheel so that the two inner tubes move synchronously. Each of the two inner tubes has its outer end provided with a moving component. The extendable table has two movable boards each having one side connected to the moving component and an opposite side, or a free side, laid on the fixed board. The two movable boards may be drawn together to form a small tabletop or pulled apart to work with the fixed board as an extended tabletop. Each of the inner tubes has a lifting member for lifting the free side of the movable board so as to facilitate expanding/retracting operation.

BRIEF DESCRIPTION OF THE DRAWINGS

FIGS. 13 through 20 are partial cross-sectional views of the extendable table of the present invention, wherein FIG. 13 shows the table retracted and fastened.

FIG. 14 shows the table released and extended.

FIG. 15 shows the movable board further pulled outward.

FIG. 16 shows the table fully extended.

FIG. 17 shows the movable board pulled out slightly lifted to have the free side of the movable board lifted before the table is retracted.

FIG. 18 shows the free side of the movable board lifted.

FIG. 19 shows the free side of the movable board lifted and the movable board pushed inward.

FIG. 20 shows the movable board pushed further inward and starting to fall on the fixed board.

DETAILED DESCRIPTION OF THE INVENTION

Figure 1:
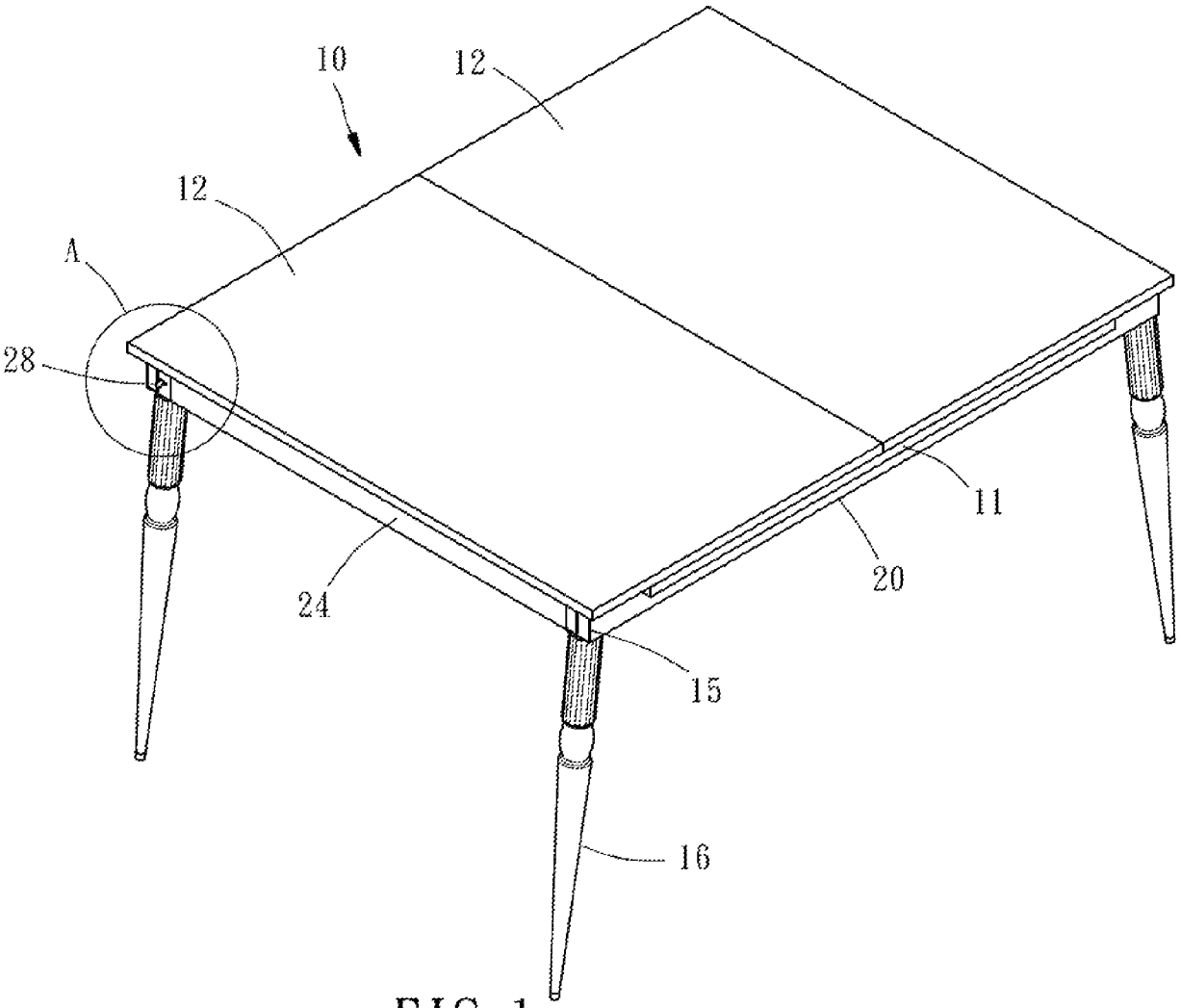
FIG. 1 is a perspective view of an extendable table according to one embodiment of the present invention, showing the table retracted.

For further illustrating the means and functions by which the present invention achieves the certain objectives, the following description, in conjunction with the accompanying drawings and preferred embodiments, is set forth as below to illustrate the implement, structure, features and effects of the subject matter of the present invention.

As shown in FIGS. 1 through 4, the disclosed extendable table (10) comprises: a frame (15) that is in the form of a square frame composed of two extension tubes (20), two connection tubes (24) and four corner pieces (25), wherein each said extension tube (20) is composed of an outer tube (21) and two inner tubes (22); four legs (16) that are fixed to the frame (15) from below individually; a fixed board (11) that is fixedly mounted on the two outer tubes (21) of the frame (15); four moving components (26) that are rotatably provided on the outer end of the four inner tubes (22); two movable boards (12) each having one side fixed to the corresponding moving components (26); four lifting members (27) that are installed in the four inner tubes (22) for lifting the free side (120) of the movable board (12).

Figure 5:
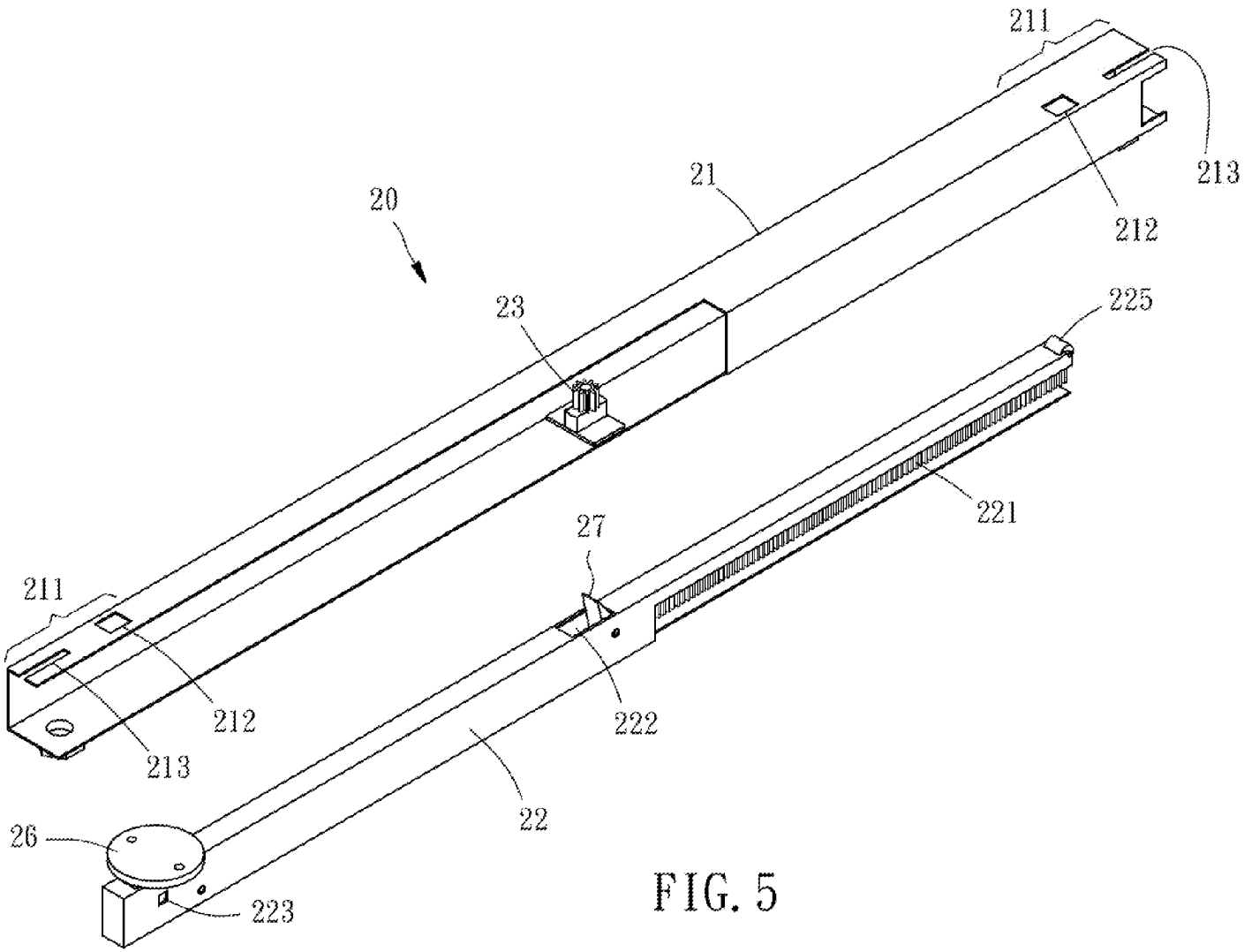
FIG. 5 is an exploded view of the extension tube (20) of the table.
Figure 6:
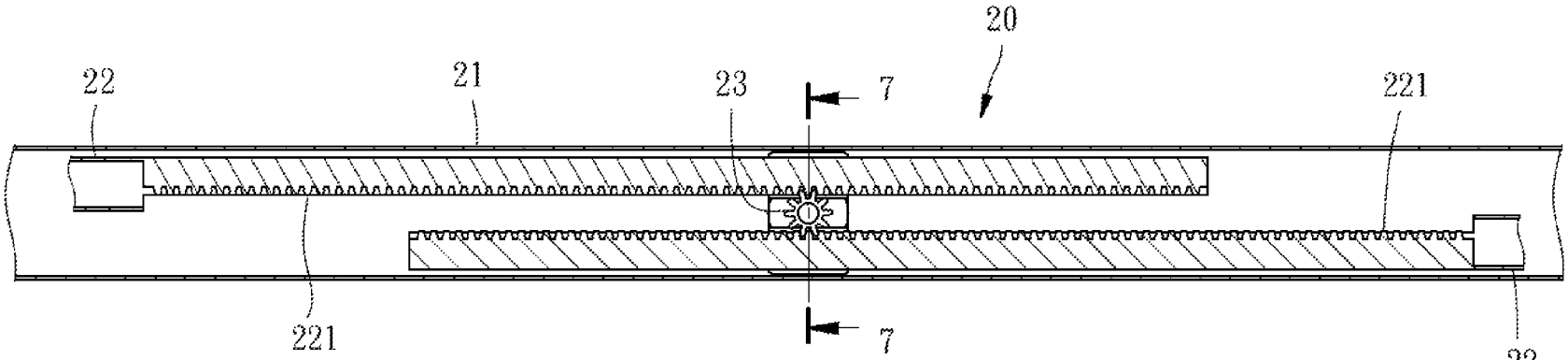
FIG. 6 is a cross-sectional view of the extension tube.
Figure 7:
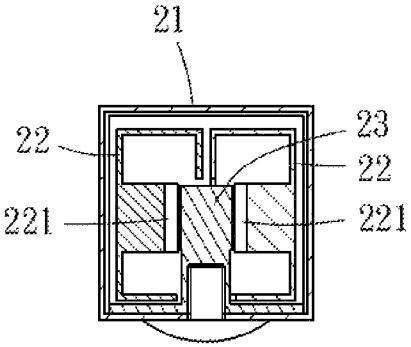
FIG. 7 is a cross-sectional view of the extension tube taken along Line 7-7 of FIG. 6.

As shown in FIGS. 5 through 7, each said extension tube (20) has a gear wheel (23) arranged at the middle part of the outer tube (21) and two gear racks (221) each provided on the wall of one said inner tube (22). The two inner tubes (22) are arranged abreast inside the outer tube (21) so that their gear racks (221) engage with the gear wheel (23) oppositely, and thereby they move synchronously.

Figure 8:
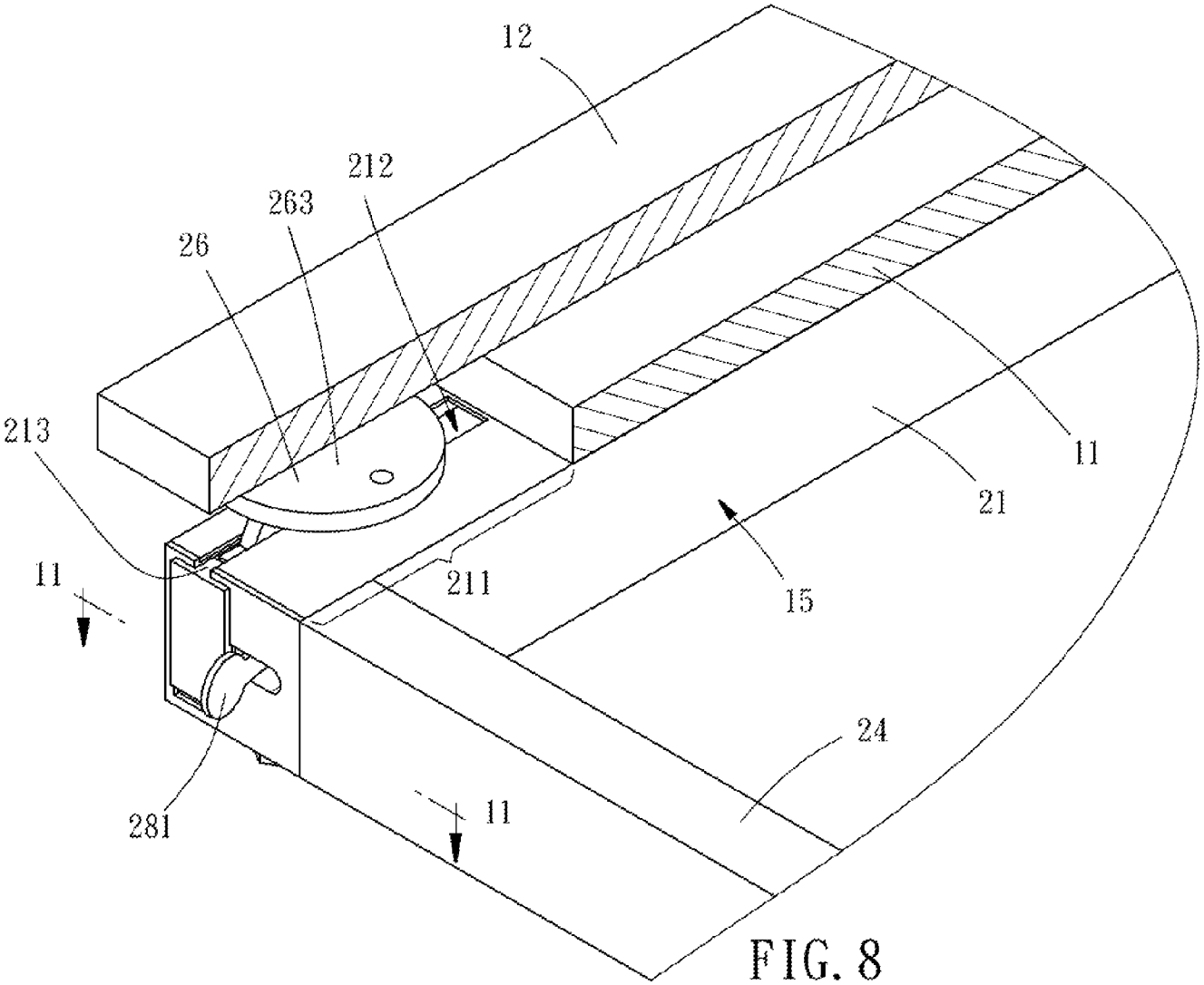
FIG. 8 is a partial cutaway view of the part marked as Circle A in FIG. 1.

As shown in FIG. 8, the fixed board (11) has a length smaller than that of the outer tubes (21) of the extension tubes (20), so that the two outer tubes (21) each have a projecting segment (211) jutting out the fixed board (11). Each said projecting segment (211) has a lengthwise through hole (212) near the fixed board (11) and a slot (213) near the outer end.

Figure 9:
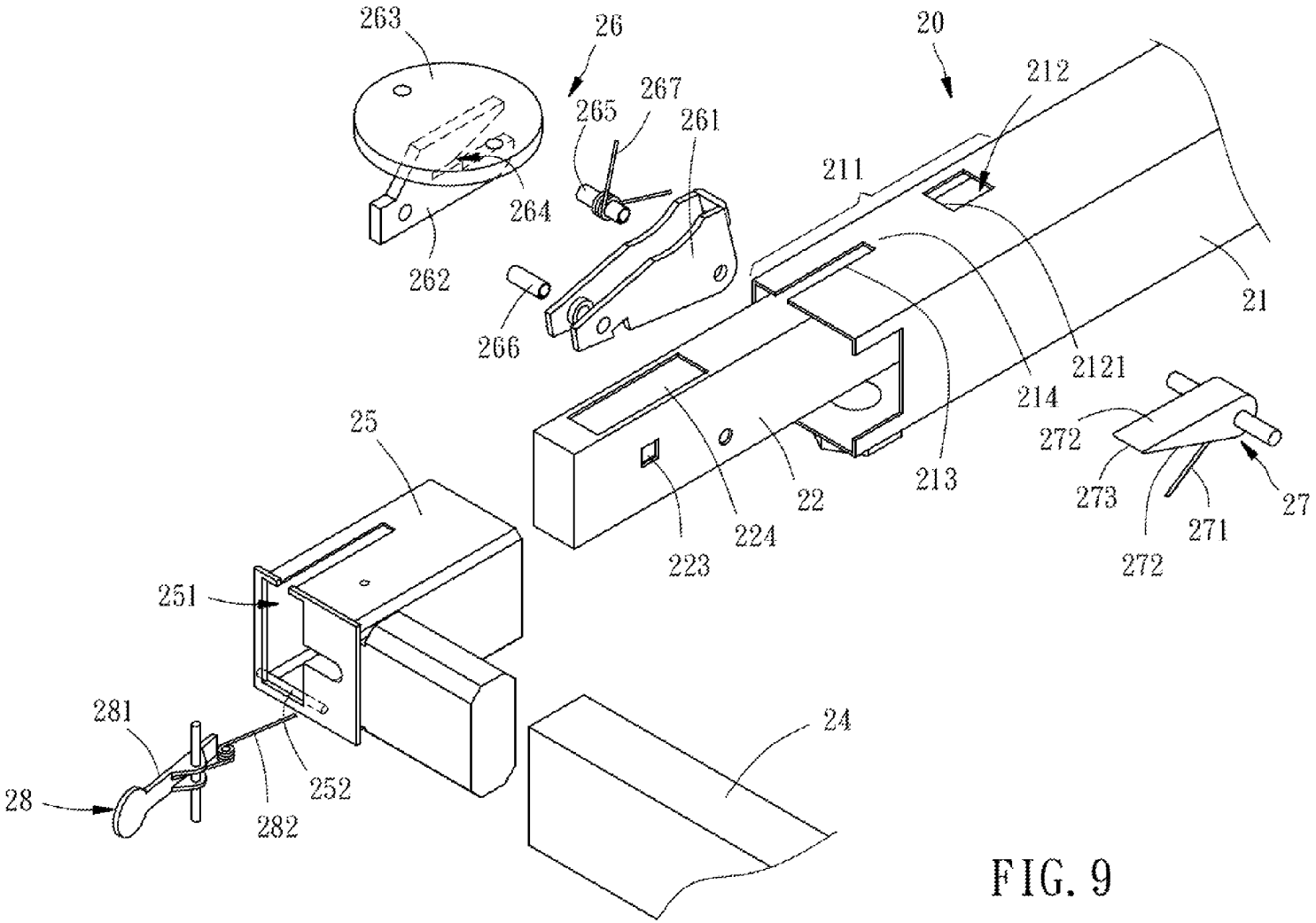
FIG. 9 is an exploded view of the frame as shown in FIG. 8.
Figure 13:
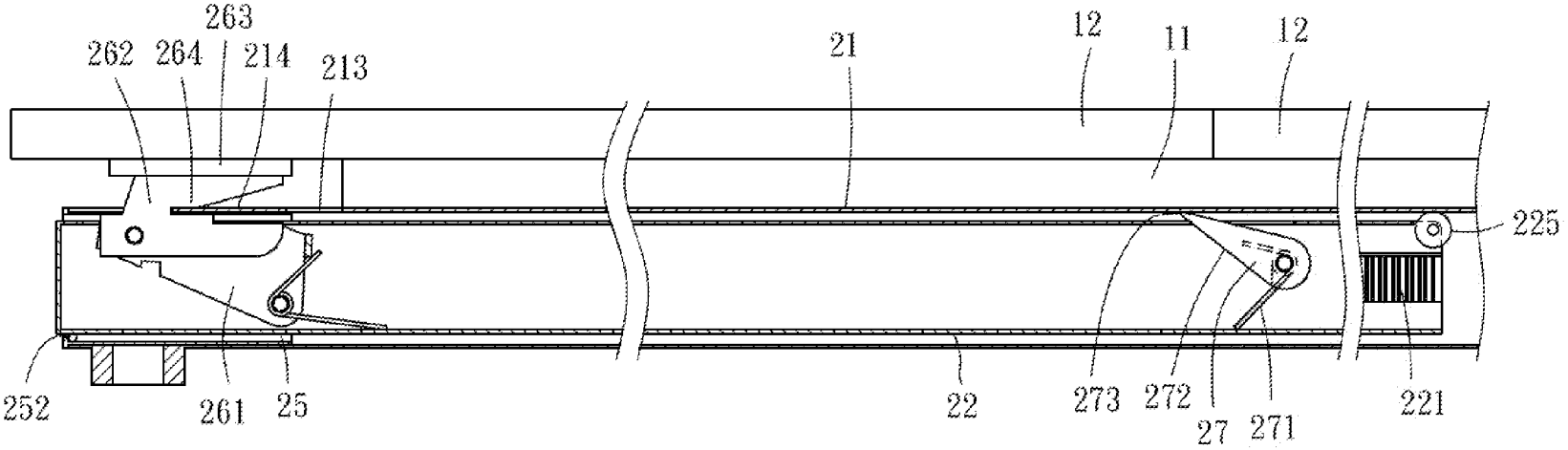

As shown in FIG. 9, the moving component (26) is a toggle mechanism that includes a first toggle (261) and a second toggle (262). The first toggle (261) has its one end pivotally connected to the outer end of the inner tube (22) from inside via a pivot (265), and the second toggle (262)

has its one end pivotally connected to the opposite end of the first toggle (261) via a pivot (266). The opposite end of the second toggle (262) is exposed outside a slender hole (224) preformed on the inner tube (22) and has a flat segment (263). A spring (267) is mounted around the pivot (265) of the first toggle (261), so as to normally bias the first toggle (261) upward. As shown in FIG. 13, the second toggle (262) has a recess (264). When the inner tube (22) is retracted to its innermost position, the recess (264) engages with the tube wall (214) at the inner side of the slot (213) of the outer tube (21), so as to achieve positioning.

Figure 10:
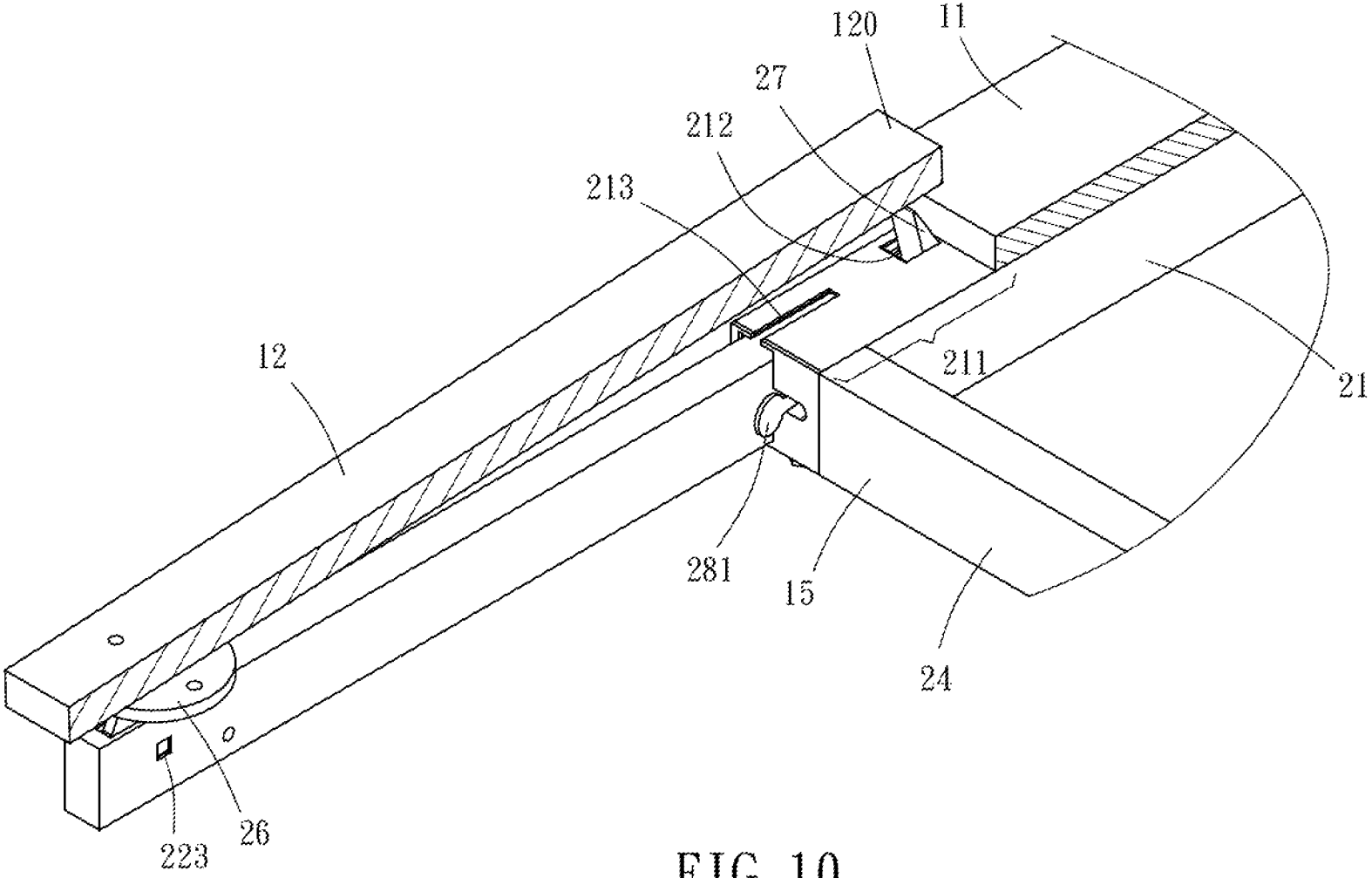
FIG. 10, similar to FIG. 8, shows the frame extended.

As shown in FIG. 10, the two movable boards (12) each have one side fixed to the flat segment (263) of the moving component (26) on the inner tube (22) of the corresponding extension tube (20), so that the opposite, free side (120) of the movable board (12) can be pivotally lifted against the moving component (26).

Figure 2:
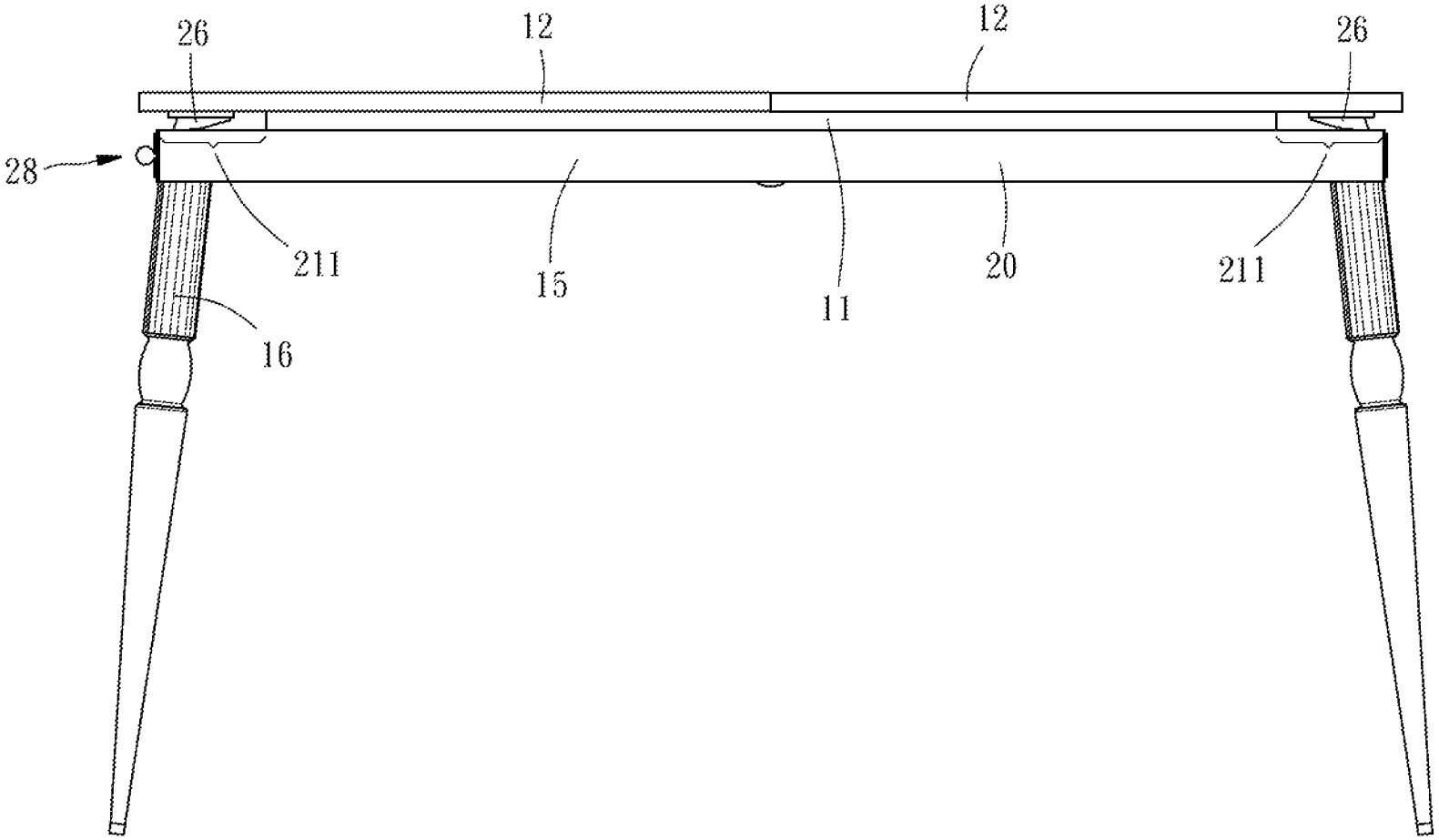
FIG. 2 is a front view of the table of FIG. 1.

As shown in FIG. 8 and FIG. 13, when the two extension tubes (20) are retracted, the two movable boards (12) have their free sides (120) laying on the fixed board (11) and jointly form a tabletop (as shown in FIGS. 1 and 2). At this time, the fixed board (11) is right below the two movable boards (12).

Figure 3:
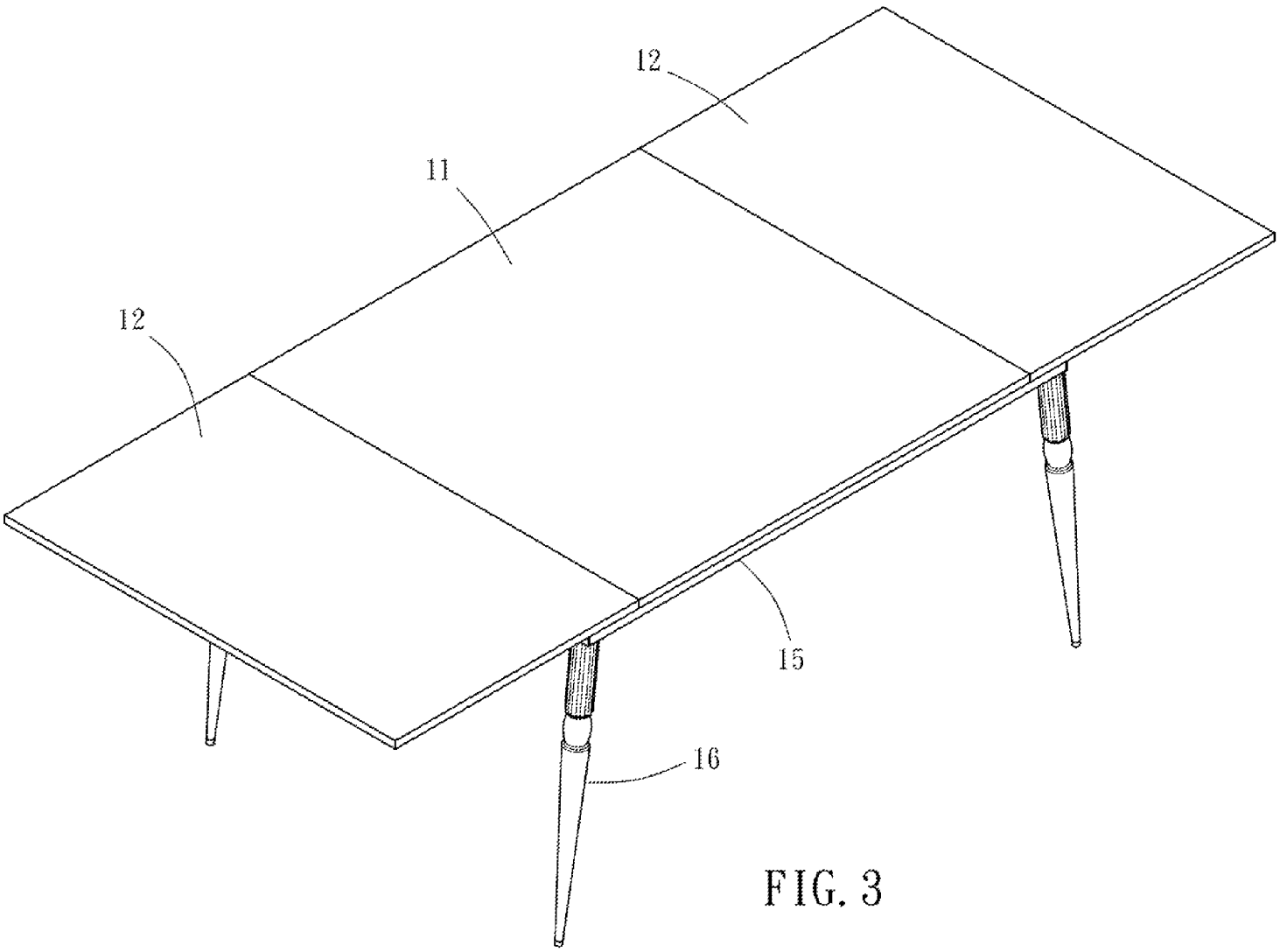
FIG. 3 is a perspective view of the extendable table in its extended state.
Figure 4:
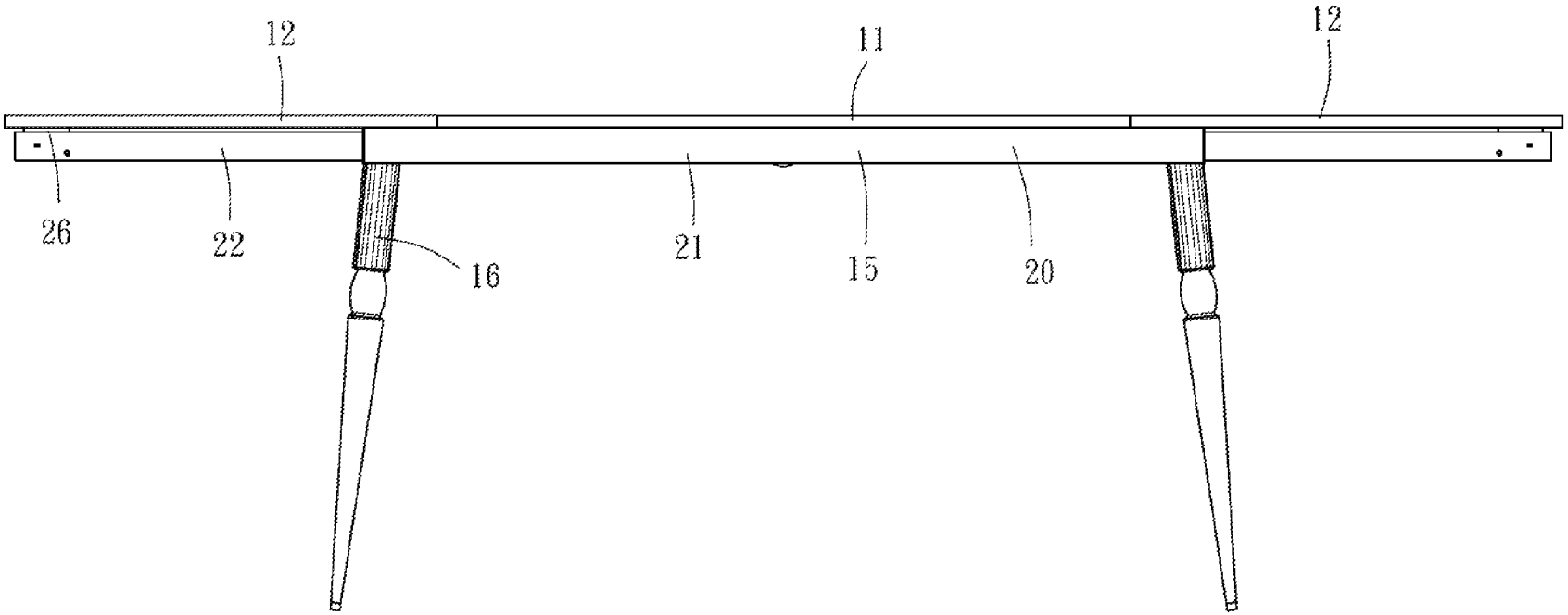
FIG. 4 is a front view of the table of FIG. 3.
Figure 16:
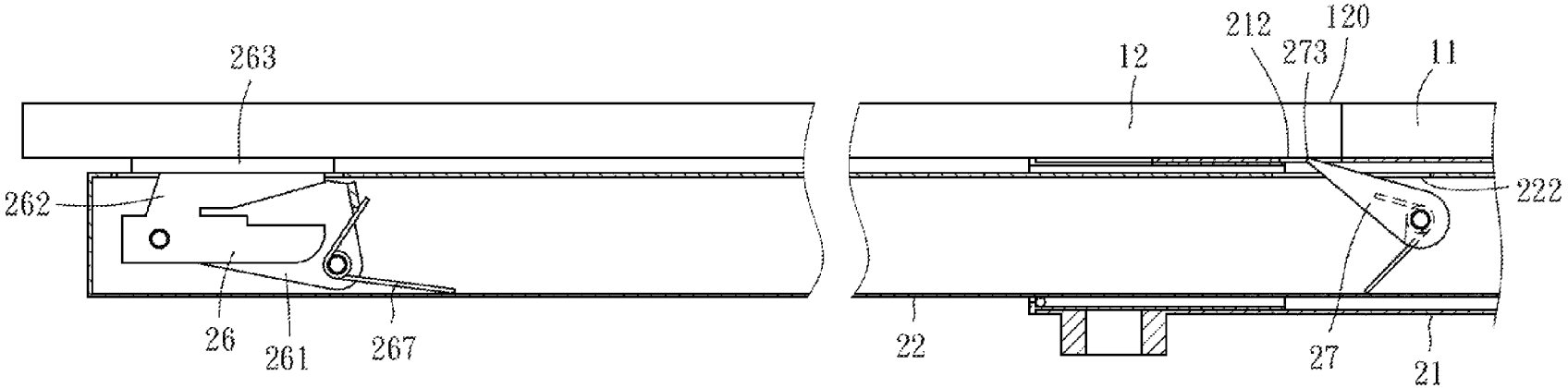

As shown in FIG. 16, when the two extension tubes (20) are extended, the two movable boards (12) have their free sides (120) laid on the projecting segments (211) of the two outer tubes (21) of the two extension tubes (20) and work with the fixed board (11) as a tabletop (as shown in FIGS. 3 and 4).

Figure 17:
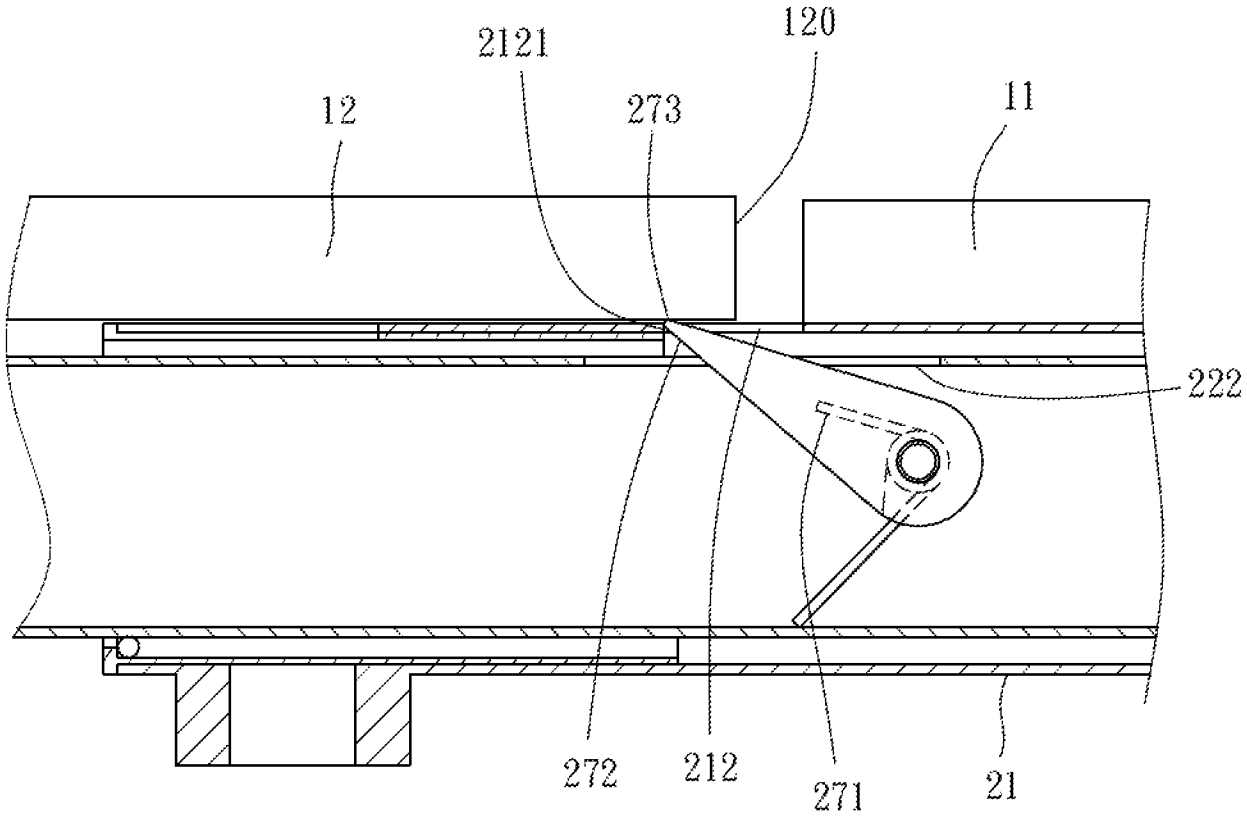
Figure 18:
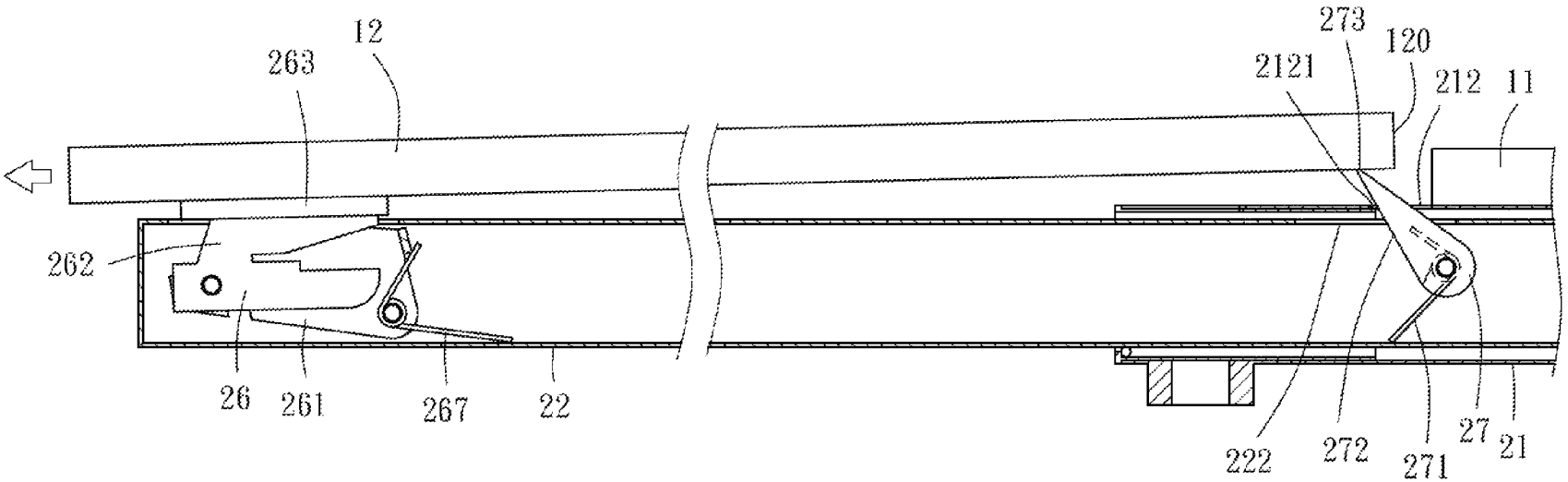

As shown in FIGS. 5, 9 and 10, the lifting member (27) is installed in the inner tube (22) for lifting the free side (120) of the movable board (12) so as to allow the free side (120) of the movable board (12) to pass over the edge of the fixed board (11) and then be laid on the fixed board (11) (as shown in FIG. 18). The lifting member (27) has one end pivotally connected in the inner tube (22). The inner tube (22) has a through hole (222) positionally corresponding to the lifting member (27), so that the opposite end of the lifting member (27) is normally biased by a spring (271) to be exposed outside the inner tube (22) for lifting the movable board (12) and when pressed falls into the inner tube (22). The opposite end of the lifting member (27) is formed as a pointy tip (273) and has two inclined planes (272). When the inner tube (22) is pulled outward, the tip (273) of the lifting member (27) touches the wall (2121) of the through hole (212) of the outer tube (21) (as shown in FIG. 17). When the inner tube (22) is further pulled outward, the lifting member (27) has its one inclined plane (272) pressing against the wall (2121) and is guided to gradually turn upright and become exposed outside the through hole (212) to push the free side (120) of the movable board (12) upward.

The four roughly L-like corner pieces (25) each have one end coupled to the outer end of the corresponding inner tube (22) and an opposite end couple to two ends of the two connecting members (24). The four corner pieces (25) each have a through hole (251) for the inner tube (22) to pass therethrough.

Figure 11:
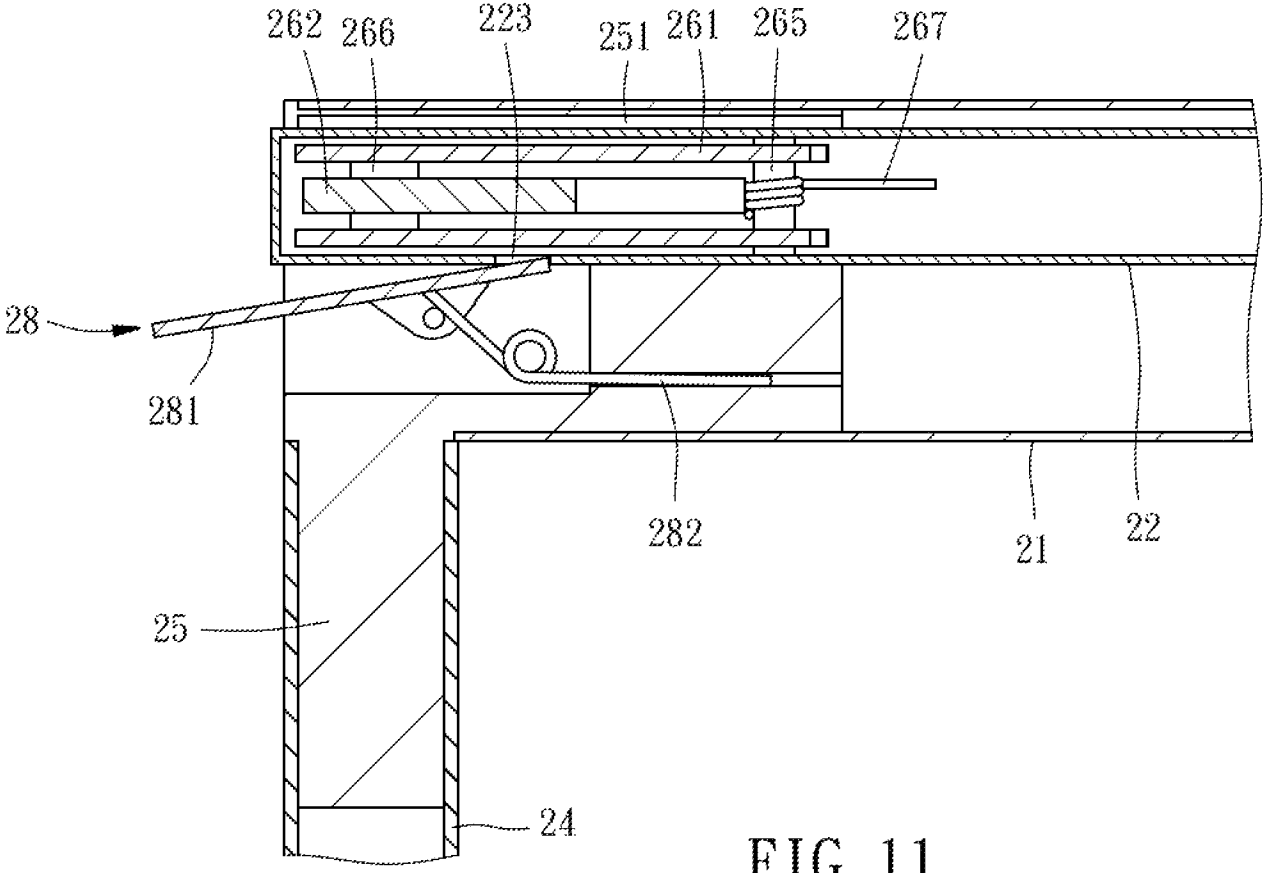
FIG. 11 is a cross-sectional view taken along Line 11-11 of FIG. 8, showing the fastening component in its fastening state.

The frame (15) comprises an engaging component (28) installed on one of the corners for holding the extension tube (20) in its retracted state (as shown in FIG. 11) and preventing the movable board (12) from accidental displacement.

The engaging component (28) comprises an engaging member (281) that is installed in one of the corner pieces (25). The inner tube (22) passing through the corner piece (25) that has the engaging component (28) is provided with an engaging hole (223). A spring (282) is arranged between the engaging member (281) and this very corner piece (25) for normally making the engaging member (281) engages with the engaging hole (223). The engagement can be easily released by turning the engaging member (281).

Figure 21:
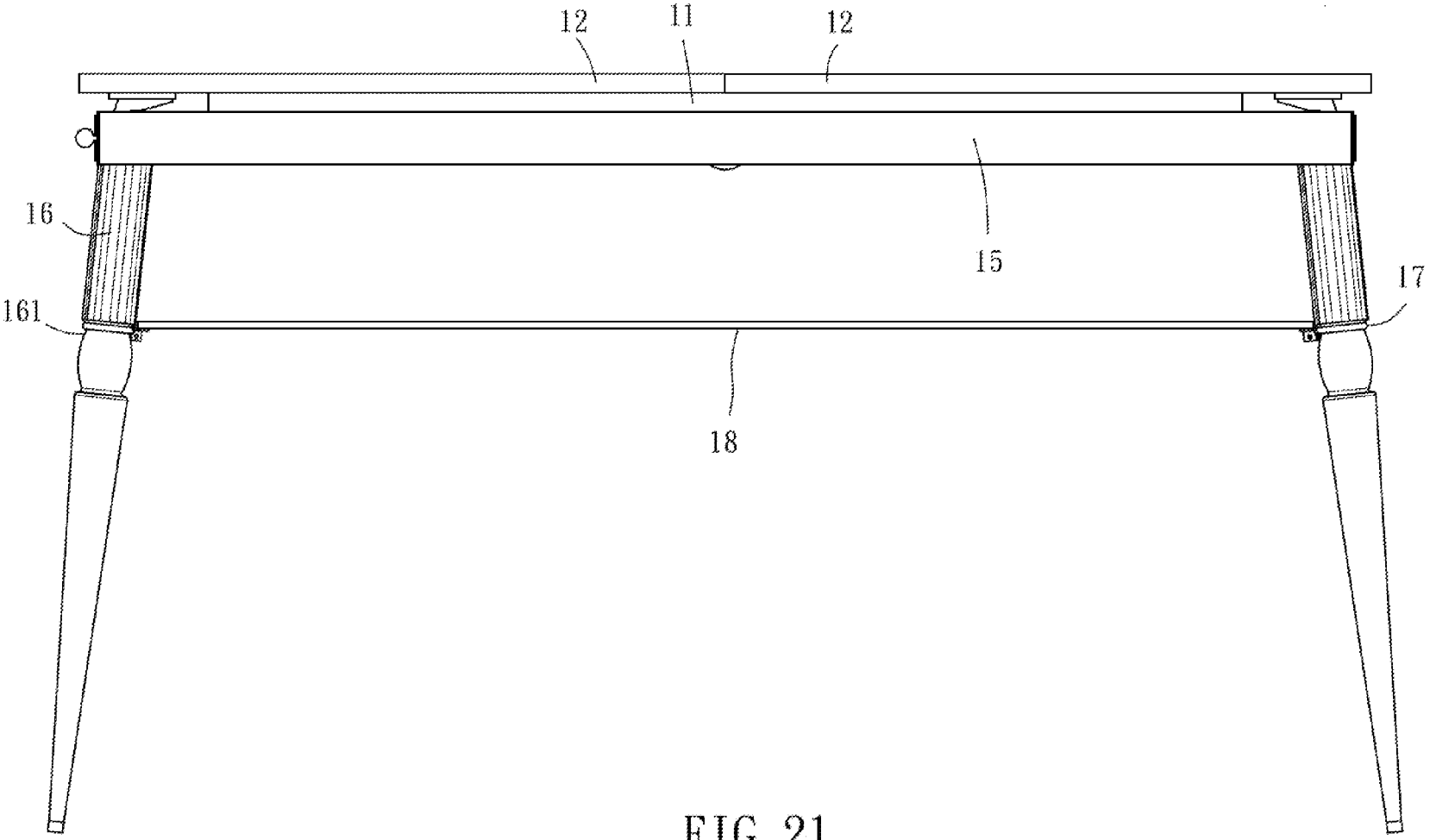
FIG. 21 is a front view of an extendable table according to another embodiment of the present invention that includes a lower board.
Figure 22:
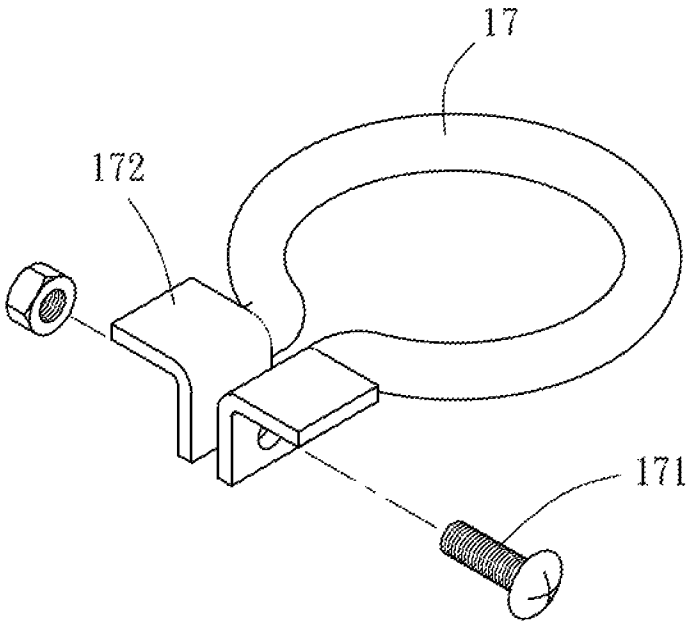
FIG. 22 is a perspective view of a C-shape collar shown in FIG. 21.

As shown in FIG. 21, a lower board (18) is supported by the four legs (16) and located below the fixed board (11). Each of the legs (16) has a small-diameter segment (161) for fittingly receiving a C-shape collar (17) as shown in FIG. 22. The collar (17) has its open portion adjustably closed by a bolt (171). The open portion of the collar (17) provides a platform (172) for the lower board (18) to be fixed thereon.

The disclosed extendable table is operated as below.

Figure 12:
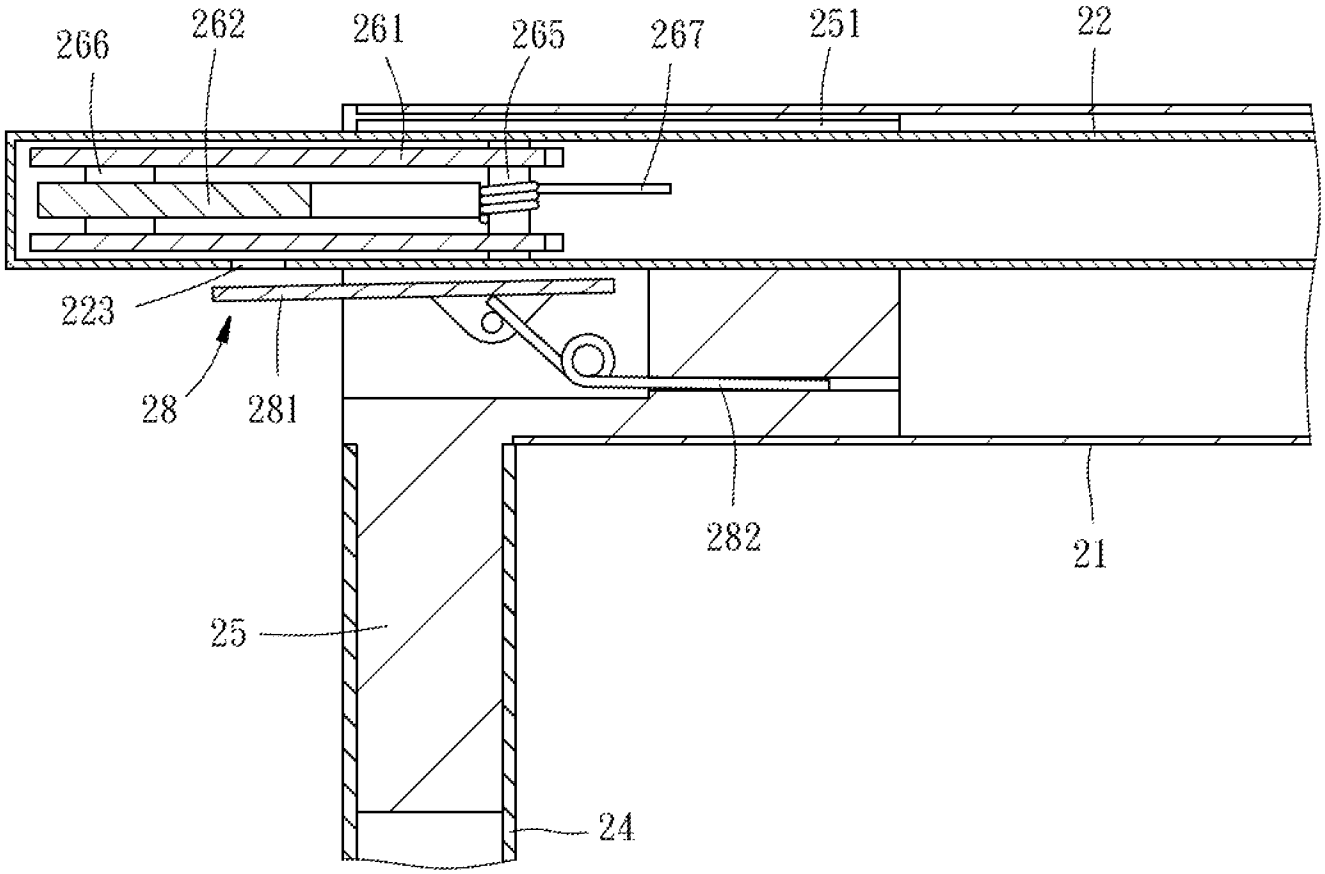
FIG. 12, similar to FIG. 11, shows the fastening component in its releasing state.

Referring to FIG. 13, the extendable table is now in its retracted state. As shown in FIGS. 8 and 11, the engaging component (28) now engages the inner tube (22). To extend the table, a user may first release the engaging member (281) as shown in FIG. 12 and then pull the movable board (12). The movable board (12) then drives the inner tubes (22) to extend outward. At the same time, the combination of the gear racks (221) on the inner tubes (22) and the gear wheel (23) makes the inner tubes (22) connected to the other movable board (12) extend outward synchronously, so that the other movable board (12) moves outward synchronously.

Figure 14:
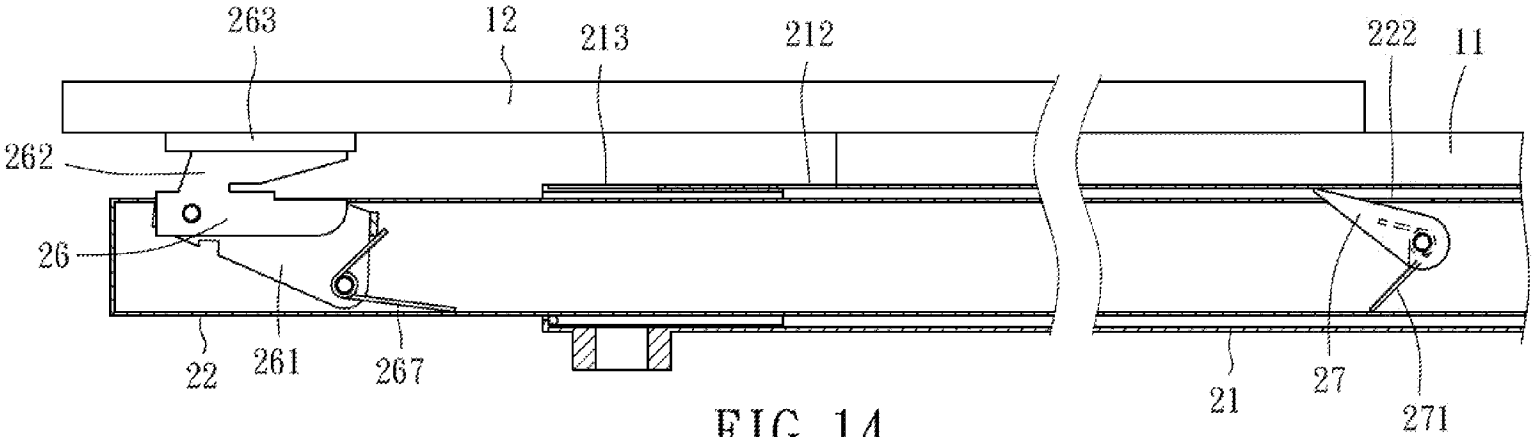
Figure 15:
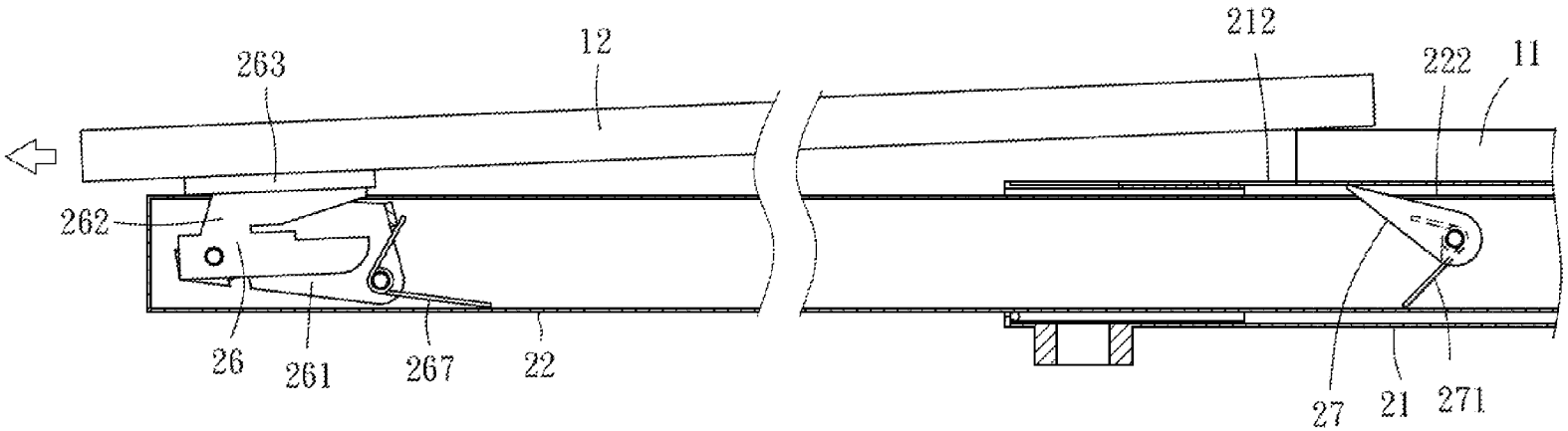

As shown in FIGS. 14, 15 and 16, when the movable board (12) moves outward, its weight compresses the moving component (25) downward so the movable board (12) become inclined, as shown in FIG. 15. As the movable board (12) is further pulled out, its free side falls on the projecting segment (211) of the outer tube (21), as shown in FIG. 16. At this time, the tip (273) of the lifting member (27) is in the through hole (212), and the movable board (12) becomes level with the fixed board (11).

Figure 19:
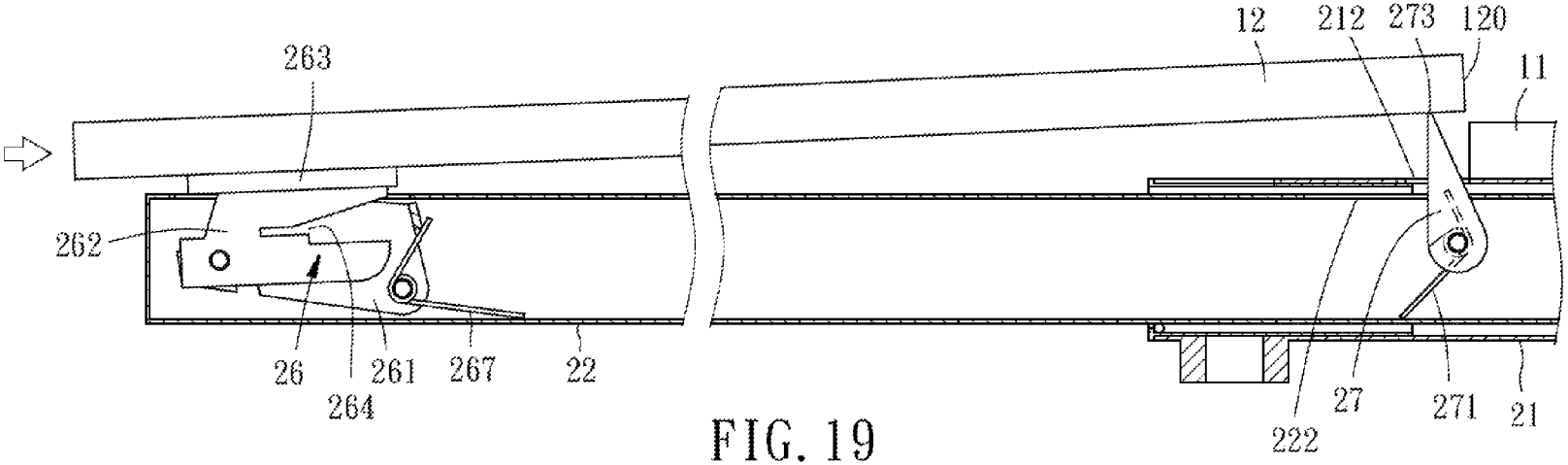
Figure 20:
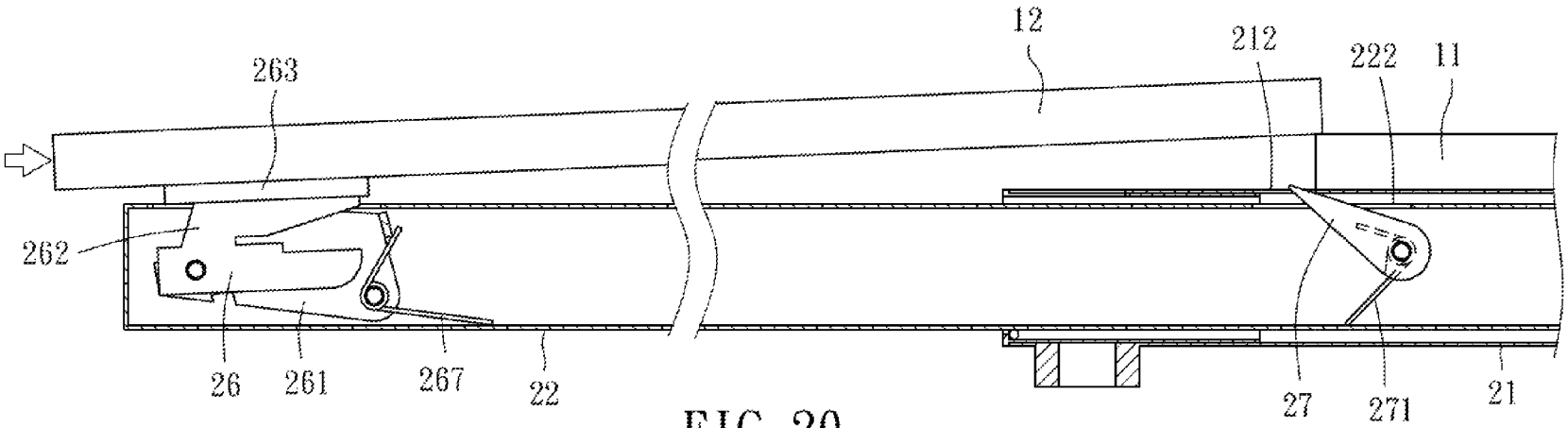

As shown in FIGS. 18, 19 and 20, for retracting the table, a user may first pull the movable board (12) slightly outward. At this time, the tip (273) of the lifting member (27) presses upon the wall (2121) of the through hole (212) of the outer tube (21) (as shown in FIG. 17). As the movable board (12) is further pulled outward, the lifting member (27) is forced to pivot upward. With the wall (2121) guiding the inclined plane (272), the lifting member (27) is posed upright and its tip (273) pushes the free side (120) of the movable board (12) upward gradually. When the free side (120) becomes higher than the fixed board (11), as shown in FIG. 19, the user can push the movable board (12) inward. At this time, the lifting member (27) presses on the opposite wall of the through hole (212) and is pushed downward to be back into the outer tube (21), as shown in FIG. 20. The free side (120) of the movable board (12) falls on the fixed board (11). Then the user continues to push the movable board (12) inward until the two movable boards (12) come together on the fixed board (11) and the recess (264) of the second toggle (262) of the moving component (26) engages with the wall (214) of the outer tube (21).

Additionally, for facilitating the movement of the inner tube (22) inside the outer tube (21), in the present embodiment, a sliding member (225) is provided at the distal end of the inner tube (22) (as shown in FIGS. 5 and 13), and a sliding member (252) is provided below the open end of the through hole (251) of the corner piece (25)(as shown in FIGS. 9 and 13).

Figure 23:
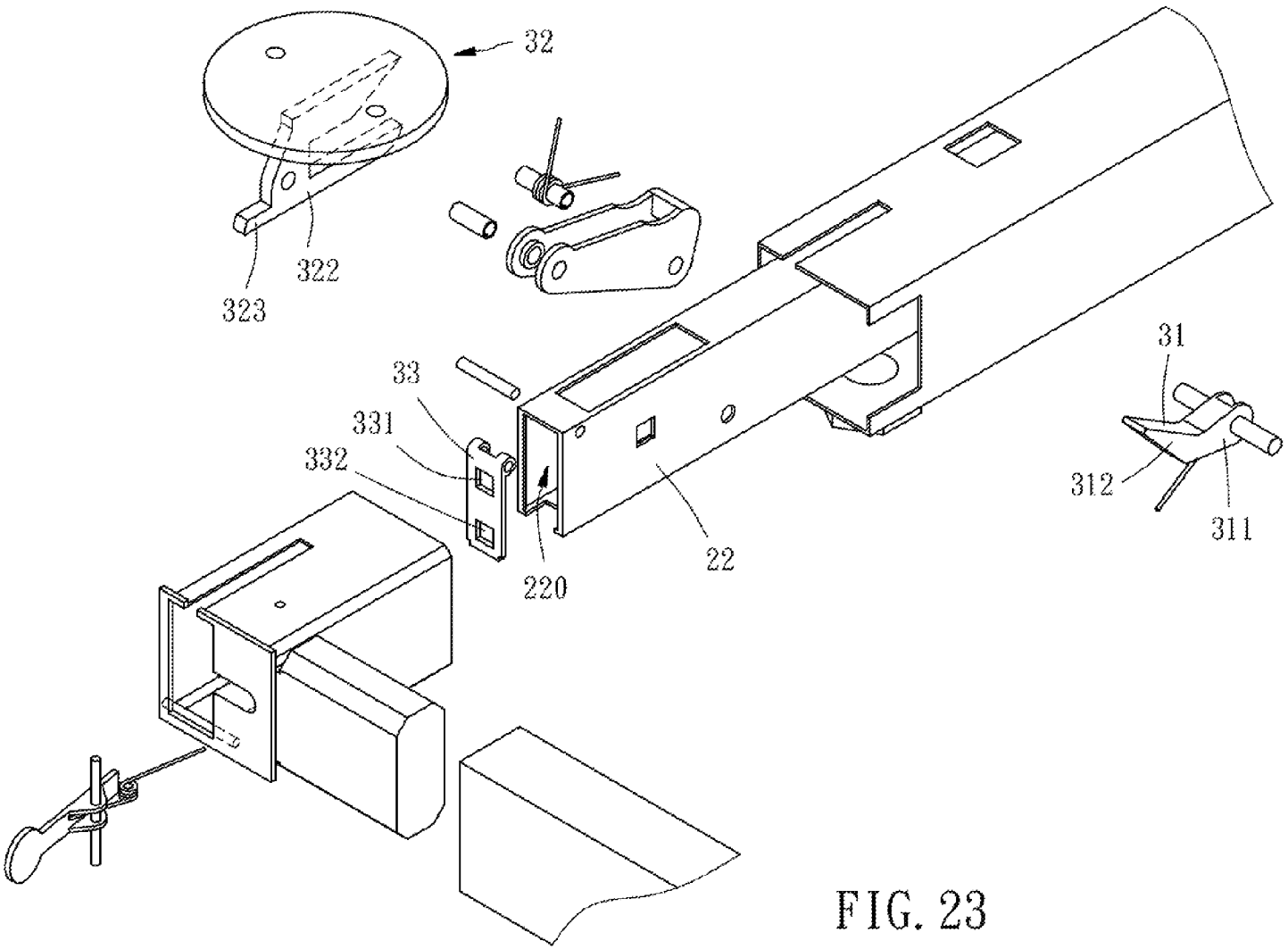
FIG. 23 is an exploded view of the frame of the extendable table according to another embodiment of the present invention.
Figure 24:
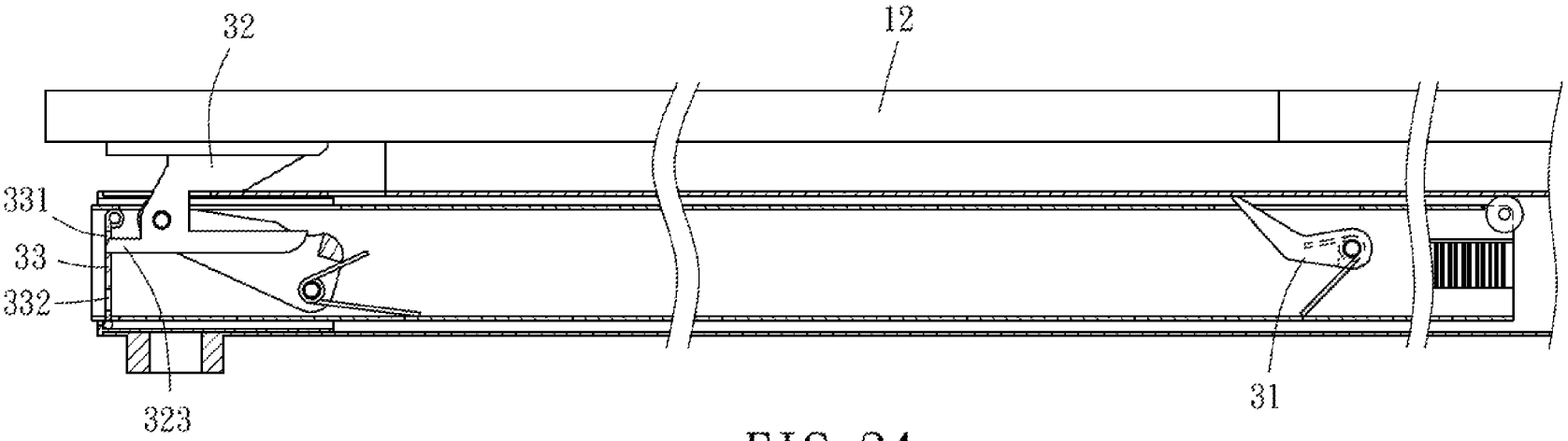
FIG. 24 through FIG. 32 illustrate operation of the extendable table the second embodiment as shown in FIG. 23.
Figure 25:
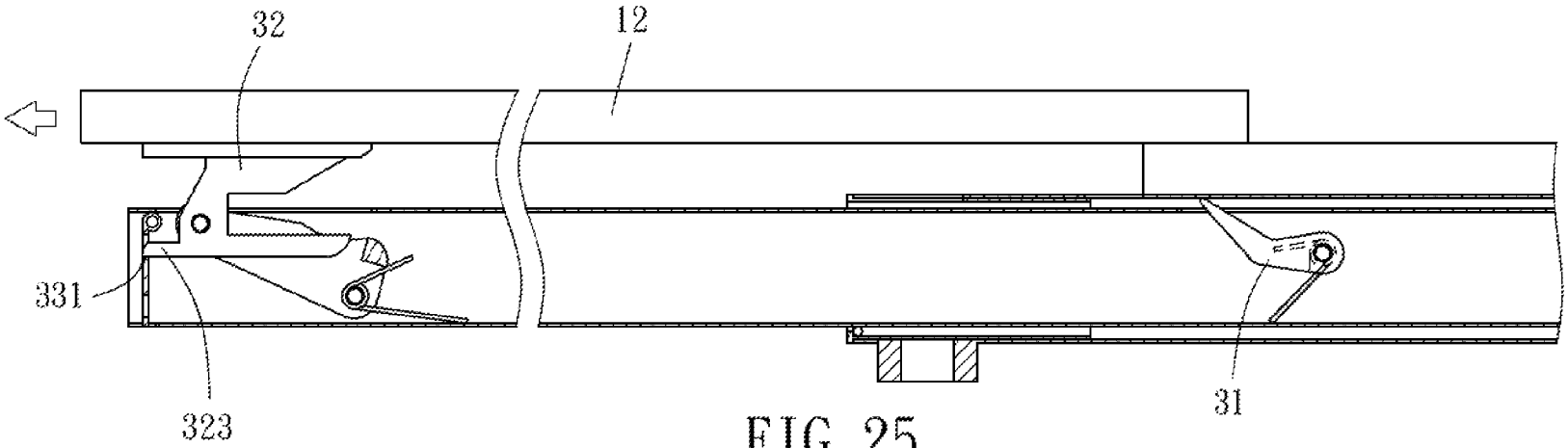
Figure 26:
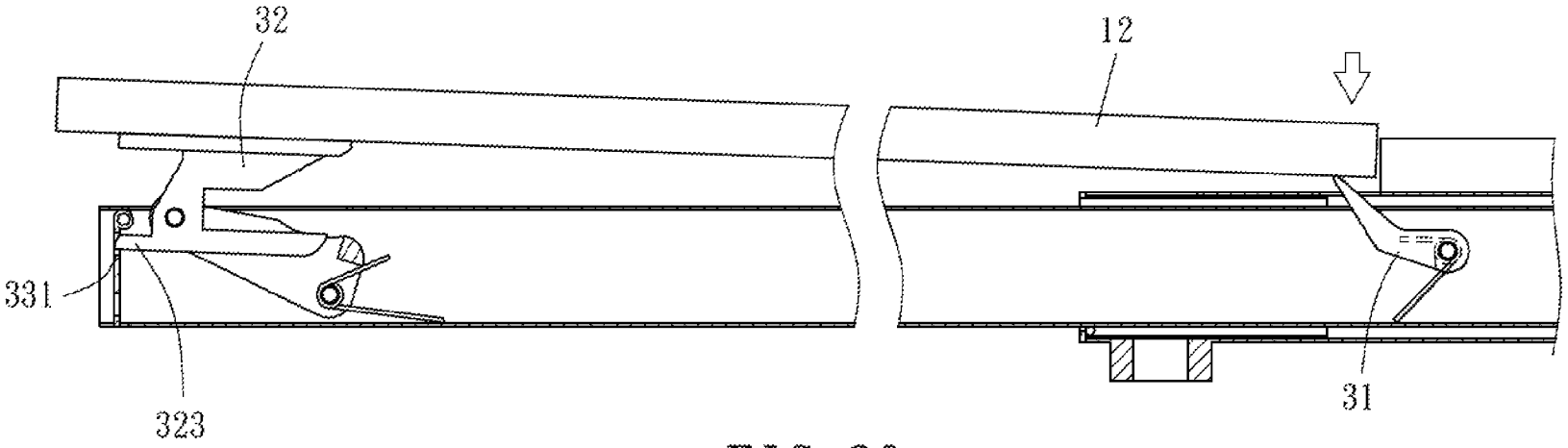
Figure 27:
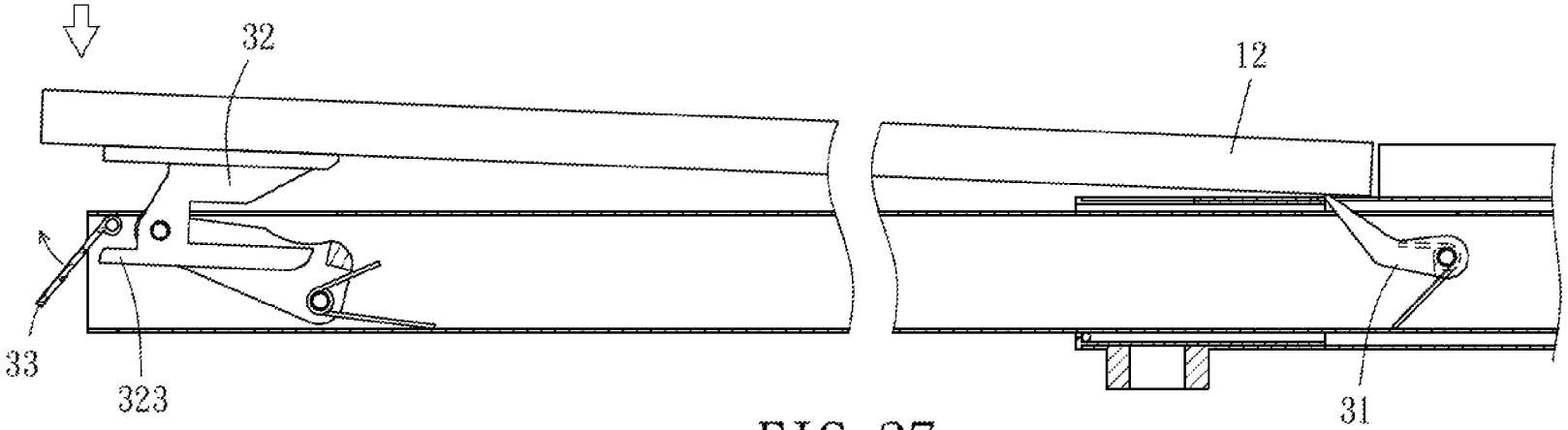
Figure 28:
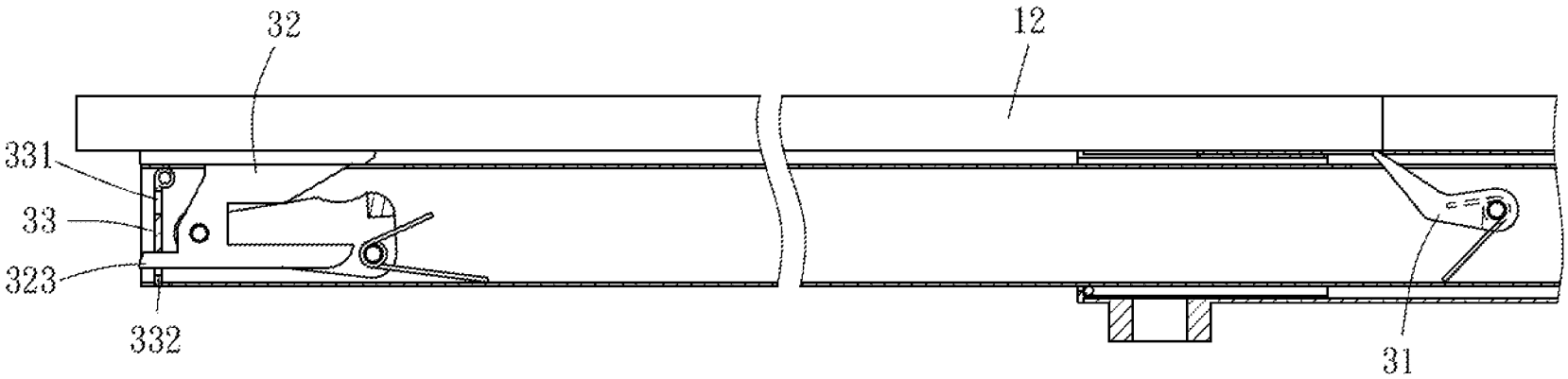
Figure 29:
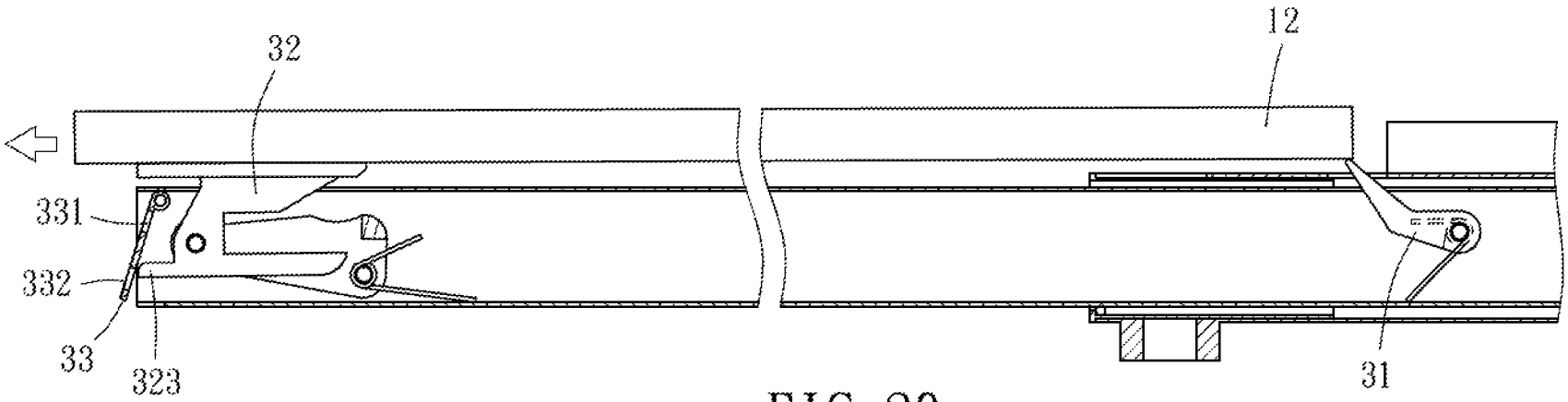
Figure 30:
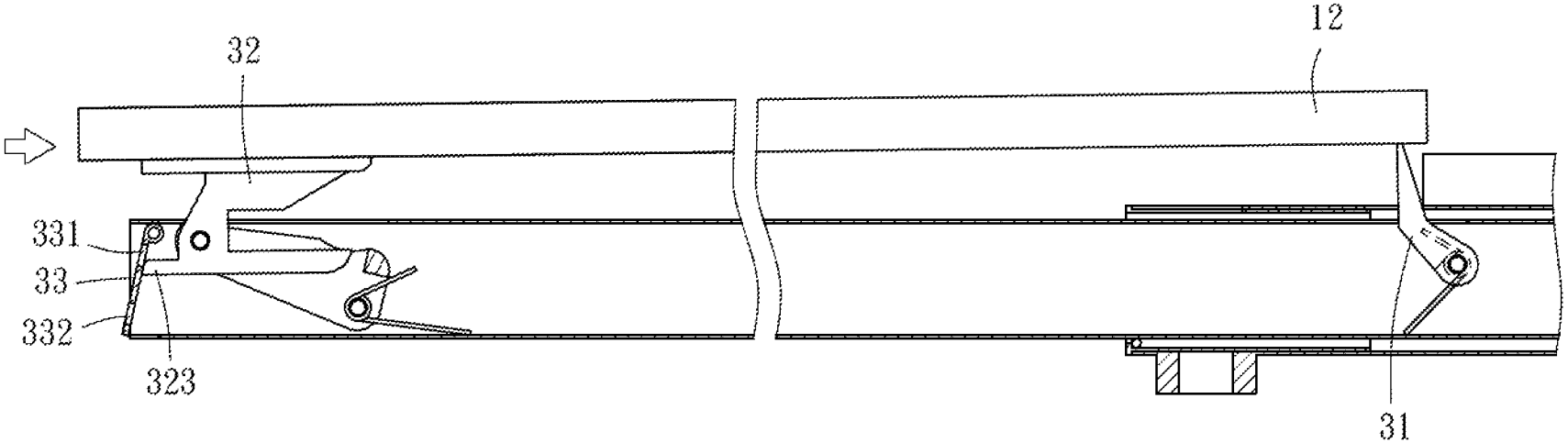
Figure 31:
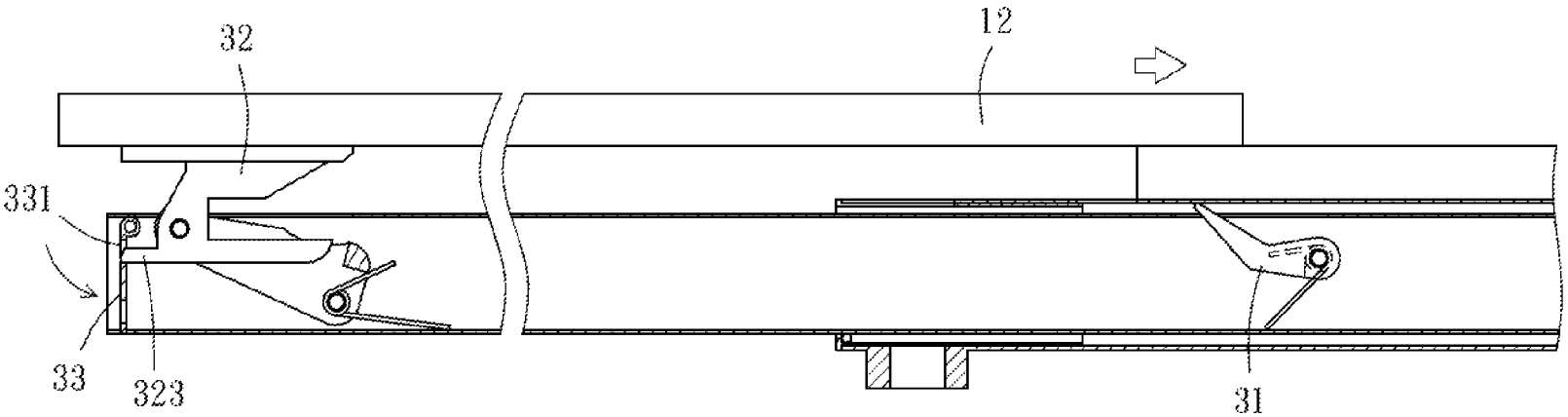
Figure 32:
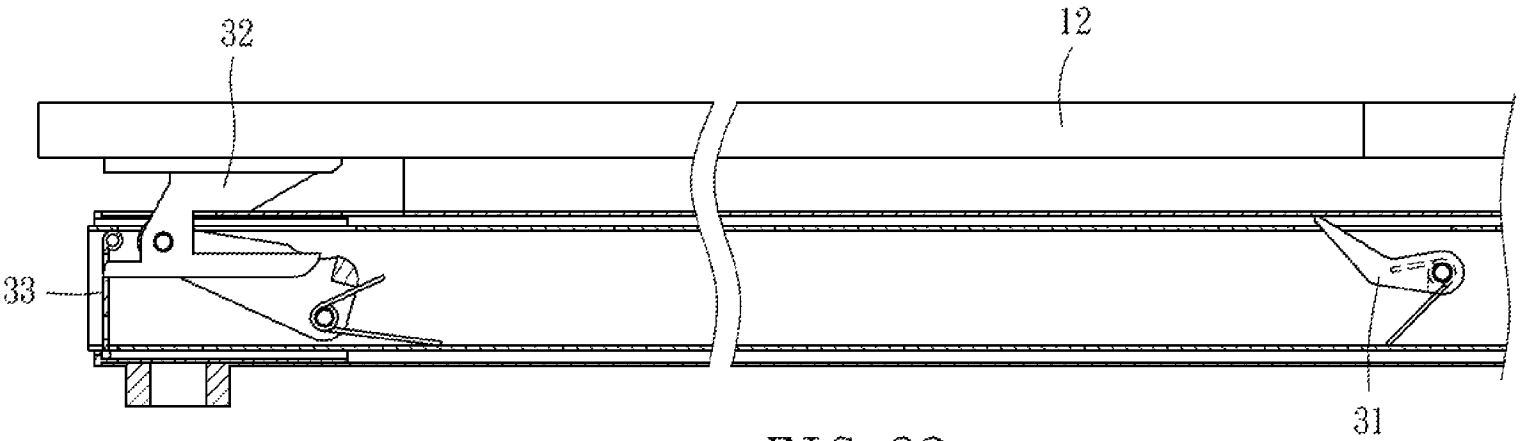

The present invention has the advantages related to simple structure and easy operation. The disclosed extendable table can be easily operated by only one person, and is exactly an innovation hitherto unknown. In FIG. 23, the frame of the extendable table according to the second embodiment of the present invention is depicted, with its elements identified by identical numbers as those for their counterparts in the first embodiment. There are two differences between the present embodiment and the first embodiment. First, the lifting member (31) of the second embodiment differently has an arm (311) and the arm (311) angularly extends a tip portion (312), so as to facilitate both the pressing movement of the movable board (12) acting on the lifting member (31) (as shown in FIG. 26) and the lifting movement of the lifting member (31) acting on the movable board (12) (as shown in FIG. 29). Secondly, a pin (323) is formed at the outer end of the second toggle (322) of the moving component (32), and an indentation (220) is provided at the outer end of the inner tube (22). A slender holding plate (33) is pivotally connected above and covers the indentation (220) and has two through holes (331) (332) vertically arranged for the pin (323) to selectively pass through. In FIG. 24, the extendable table of the second embodiment is in its retracted state, where the pin (323) is received in the upper through hole (331) of the holding plate (33). In FIG. 25, the movable board (12) is pulled outward and the moving component (32) is held by the holding plate (33) and prevented from moving downward, so the movable board (12) remains horizontal. As shown in FIG. 26, when the movable board (12) is pulled to the extent that it falls down to the fixed board (11), it presses the lifting member (31) downward. Then, as shown in FIG. 27, the holding plate (33) is flipped upward, for example, by a user's finger, and the pin (323) leaves the holding plate (33), so that the movable board (12) falls down and the extendable table is now extended, as shown in FIG. 28. At this time, the pin (323) is received in the lower through hole (332) of the holding plate (33). The table can be then retracted in the same manner as described in the first embodiment. Referring to FIG. 29, the movable board (12) is pulled outward, so that the lifting member (31) lifts the free end of the movable board (12). Then the movable board (12) is pushed inward as shown in FIG. 30, so that the movable board (12) is on the fixed board (11), as shown in FIG. 31. At this time, the holding plate (33) falls down to engage with the pin (33) again so as to keep the movable board (12) horizontal, and then the movable board (12) can be further pushed inward to the retracted state, as shown in FIG. 32. The second embodiment features that the movable boards (12) remain horizontal during the process of being extended or retracted, which means the table of the present invention can serve as a normal table even in its semi-extended state.

What is claimed is:

1. An extendable table, comprising:

two extension tubes each having an outer tube and two inner tubes, a gear wheel being provided at a middle part of the outer tube, a gear rack provided at on a wall of each of the two inner tubes, the two inner tubes being arranged abreast in the outer tube so that the gear racks engage with the gear wheel, and the two extension tubes being arranged in parallel;

two connection tubes each having two opposite ends thereof connected to the outer tube of the corresponding extension tube, so as to form a frame;

four legs being fixed to the frame from below;

a fixed board being fixed on the two outer tubes;

four moving components each being pivotally connected to an outer end of the corresponding inner tubes;

two movable boards each having one side fixed to two moving components on the corresponding two inner tubes of the two extension tubes, so that a free side of the movable board is pivotally liftable against the two moving components, wherein when the two extension tubes are retracted, the two movable boards are laid on the fixed board and jointly form a tabletop, with the fixed board located right below the two movable boards, and when the two extension tubes are extended, the two movable boards are laid on the two corresponding inner tubes of the two extension tubes and work with the fixed board as a tabletop; and each said inner tube being provided with a lifting member for lifting the free side of the corresponding movable board, so as to allow the free side to pass over an edge of the fixed board and be laid on the fixed board;

wherein the fixed board has a length smaller than a length of each of the two outer tubes, so that a projecting segment is formed on each of the two outer tubes and the two projecting segments jutting out two opposite sides of the fixed board, each of the projecting segments having a lengthwise through hole near the fixed board, the lifting member having one end pivotally connected in the inner tube, the inner tube having a through hole positionally corresponding to the lifting member that allows an opposite end of the lifting member to be normally biased by a spring and exposed outside the inner tube for lifting the movable board, the opposite end of the lifting member when pushed being retracted into the inner tube, the opposite end of the lifting member being formed as a pointy tip and having an inclined plane, so that when the inner tube is pull outward, the tip of the lifting member contacts a wall of the through hole of the outer tube and the inclined plane works with the wall to guide the lifting member to project to lift the free side of the movable board;

wherein the moving component is a toggle component that comprises a first toggle and a second toggle, the first toggle having one end pivotally connected in the outer end of the inner tube, the second toggle having one end pivotally connected to an opposite end of the first toggle, and the second toggle having an opposite end exposed outside the inner tube and having a flat segment for the movable board to be fixed thereon.

2. The extendable table of claim 1, wherein a slot is formed on an outer end of the projecting segment the outer tube, and a recess is formed on the second toggle of the toggle component, so that when the inner tube is retracted to an innermost position thereof, the recess engages with the wall inside the slot for positioning.

3. The extendable table of claim 1, further comprising a lower board supported by the four legs and located below the fixed board.

4. The extendable table of claim 3, wherein the leg has a small-diameter segment for fittingly receiving a C-shape collar, in which the collar has an open portion adjustably closed by a bolt and the open portion of the collar provides a platform for the lower board to be fixed thereon.

5. The extendable table of claim 1, further comprising four roughly L-like corner pieces each having one end coupled to the outer end of the corresponding inner tube and an opposite end couple to two ends of the two connecting members, wherein the four corner pieces each have a through hole for the inner tube to pass therethrough.

6. The extendable table of claim 5, further comprising an engaging component installed in one corner of the frame for holding the extension tube in a retracted state thereof.

7. The extendable table of claim 6, wherein the engaging component comprises an engaging member installed in one of the corner pieces, and the inner tube passing through the corner piece that has the engaging component is provided with an engaging hole, in which a spring is arranged between the engaging member and the corner piece for normally making the engaging member engage with the engaging hole.

8. The extendable table of claim 1, wherein the second toggle of the moving component has a pin, and the inner tube has its outer end formed with an indentation, in which a holding plate is pivotally connected above and covers the indentation, and the holding plate has two through holes for the pin to selectively past therethrough.

* * * * *